US011594384B2

(12) United States Patent
Mucha et al.

(10) Patent No.: US 11,594,384 B2
(45) Date of Patent: Feb. 28, 2023

(54) SWITCH ASSEMBLY

(71) Applicant: Aptiv Technologies Limited, St. Michael (BB)

(72) Inventors: Rafal Mucha, Cracow (PL); Lukasz Bohdan, Cracow (PL); Janusz Lipka, Wieliczka (PL)

(73) Assignee: Aptiv Technologies Limited, St. Michael (BB)

( * ) Notice: Subject to any disclaimer, the term of this patent is extended or adjusted under 35 U.S.C. 154(b) by 0 days.

(21) Appl. No.: 17/930,306

(22) Filed: Sep. 7, 2022

(65) Prior Publication Data

US 2023/0005678 A1 Jan. 5, 2023

Related U.S. Application Data

(63) Continuation of application No. 17/177,983, filed on Feb. 17, 2021, now Pat. No. 11,482,388.

(30) Foreign Application Priority Data

Mar. 27, 2020 (EP) ..... 20166517

(51) Int. Cl.
*H01H 13/14* (2006.01)
*H01H 13/04* (2006.01)
*H01H 13/20* (2006.01)

(52) U.S. Cl.
CPC ..... *H01H 13/14* (2013.01); *H01H 13/04* (2013.01); *H01H 13/20* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS

| | | | | |
|---|---|---|---|---|
| 10,312,032 | B1 | 6/2019 | Chu | |
| 2002/0027062 | A1 | 3/2002 | Shibutani et al. | |
| 2010/0270133 | A1* | 10/2010 | Baker | H01H 25/041 200/4 |
| 2012/0097507 | A1* | 4/2012 | Leng | H01H 25/006 200/4 |

(Continued)

FOREIGN PATENT DOCUMENTS

| | | | |
|---|---|---|---|
| DE | 9421644 | U1 | 5/1996 |
| DE | 102004032335 | A1 | 2/2005 |

(Continued)

OTHER PUBLICATIONS

"Extended European Search Report", EP Application No. 20166517.1, dated Oct. 2, 2020, 8 pages.

*Primary Examiner* — Ahmed M Saeed
(74) *Attorney, Agent, or Firm* — Sawtooth Patent Group PLLC

(57) ABSTRACT

A switch assembly including a socket, a top cap, and an intermediate cart located in the socket. The intermediate cart is slidable with the socket. The top cap is in a spherical or pivot engagement with the intermediate cart. An activation force of the sliding movement is lower than an activation force of the spherical or pivot movement.

20 Claims, 5 Drawing Sheets

(56) References Cited

U.S. PATENT DOCUMENTS

2014/0069788 A1 3/2014 Hisada et al.

FOREIGN PATENT DOCUMENTS

| | | | |
|---|---|---|---|
| DE | 602004000138 | | 5/2006 |
| DE | 102008024167 | | 8/2009 |
| EP | 1584096 | B1 | 6/2007 |
| EP | 2141718 | B1 | 1/2013 |

* cited by examiner

SWITCH ASSEMBLY

CROSS-REFERENCE TO RELATED APPLICATIONS

This application is a continuation of U.S. patent application Ser. No. 17/177,983, filed Feb. 17, 2021, which claims priority to European Patent Application Number EP20166517.1, filed Mar. 27, 2020, the disclosures of which are hereby incorporated by reference in their entireties herein.

BACKGROUND

The present disclosure relates to the field of switch assemblies. Such switch assemblies can be used for example in a vehicle such as on a dashboard and/or on any control panel.

Switches, buttons or controls are widely used, for example for using electronic appliances at home, in the industry or in a vehicle. In particular, car dashboards are usually provided with switches in order to trigger safety or comfort functions, such as headlights, windshield wipers, air conditioning or to interact with multimedia functions of the car infotainment system.

Among switch assemblies currently used in vehicles, capacitive switches detect a contact between the finger of a user and a touch-sensitive surface of the switch. However, these capacitive switches do not provide haptic feedback and are not always appreciated for this reason.

Toggle switches have the advantage of providing a haptic feedback. Further, several actions can be triggered and/or selected with a single toggle switch. An example of a toggle switch is described in document DE9421644U1. However, such a toggle switch has the disadvantage that a space must exist between the top cap, which is pressed by a user, and a cover surrounding the top cap, such as a cover surface of the dashboard or the control panel. Such a space may allow dust and particles to penetrate the inside of the toggle switch and does not provide for a high level of perceived quality.

Consequently, the present disclosure relates to a switch assembly providing a haptic feedback with a minimal space between a top cap of the switch assembly and a cover surrounding the top cap.

SUMMARY

The present disclosure concerns a switch assembly including: a socket, a top cap and an intermediate cart located in the socket, wherein: the intermediate cart is slidable with regard to the socket, the top cap is in a spherical or pivot engagement with the intermediate cart, and wherein an activation force of the sliding movement is lower than an activation force of the pivot movement.

Consequently, a pressure on the top cap is first transmitted to the intermediate cart and the top cap and the intermediate cart both translate along a first axis. Then, an increased pressure may trigger the pivot movement or rotation movement of the top cap around a second axis.

This switch assembly allows to trigger at least one function while requiring only a tiny gap between the top cap and a cover, for example located flush or at least surrounding the top cap. This tiny gap limits the dust entering the switch assembly and provides a more attractive appearance of the switch assembly and a higher perceived quality.

In aspects, the switch assembly has at least one intermediate contactor which is activated by the pivot movement of the top cap.

In aspects, the at least one intermediate contactor is located between the top cap and the intermediate cart, the at least one intermediate contactor defining at least part of the activation force of the pivot or spherical movement. This embodiment provides a cost-efficient and visually attractive switch assembly.

In aspects, the socket has a bottom surface and at least one elastic member arranged between the intermediate cart and the bottom surface, the at least one elastic member defining at least part of the activation force of the sliding movement.

In aspects, the elastic member brings back the top cap from the switch position (after the translation movement) to the initial position or rest position.

In aspects, the switch assembly has at least one bottom contactor which is activated by the sliding movement of the intermediate cart. This bottom contactor allows to perform another action or trigger another function with the same switch assembly.

In aspects, the at least one elastic member is or includes the at least one bottom contactor. The contactor may be electrically connected if a double action (i.e. with two clicks) switch assembly is required or not electrically connected if only a single action (i.e. with one click) switch assembly is required. Alternatively or in combination, elastic elements or one or several spring members may be used to generate the appropriate activation forces and/or provide the appropriate haptic feedback.

In aspects, the intermediate cart is slidable with regard the socket along a first axis, which allows a smooth translation movement. For example, the top cap may be substantially planar and this first axis may be orthogonal to the top cap.

In aspects, the top cap is in a pivot engagement with the intermediate cart around a second axis, or in a spherical engagement with the intermediate cart along two second axes. Preferably the second axis or the second axes are orthogonal to the first axis, for example a plan parallel to the top cap.

In aspects, the top cap includes at least a first pushing surface and a second pushing surface and the at least one intermediate contactor is aligned with the first pushing surface along a third axis parallel to the first axis. Such a switch assembly is reliable, provides a smooth activation of the intermediate contactor and can control several functions through several different interactions.

In aspects, the at least one bottom contactor is aligned with the second pushing surface along the first axis, or with the second pushing surface along the first axis, in order to provide a natural activation of the switch assembly.

In aspects, the top cap includes a third pushing surface and the switch assembly includes at least another intermediate contactor aligned with the third pushing surface along a fourth axis parallel to and offset from the third axis. This switch assembly allows to intuitively command multiple functions. For example, the first pushing surface and the third pushing surface are located on both sides of the second axis and/or on both sides of the second pushing surface.

In aspects, at least one of the pushing surfaces of the top cap are provided with a touch sensor that can detect a contact, for example with a user or a user's finger. Preferably, each of the pushing surfaces of the top cap are provided with a touch sensor. This switch assembly allows to intuitively command multiple functions.

In aspects, the switch assembly includes a pusher located between the top cap and the at least one intermediate contactor, in order to transfer a pressure from the top cap to the intermediate contactor. This pusher provides a stable transfer of a pressure between the top cap and the intermediate contactor and a smooth activation of the switch assembly.

A second aspect of the disclosure concerns a switch assembly including: an intermediate cart translating along a first axis according to a push activation force; at least one intermediate contactor fixed to the intermediate cart; a top cap rocking or pivoting around a second axis with regard to the intermediate cart and triggering the at least one intermediate contactor, wherein when a pressure is applied on the top cap, the top cap and the intermediate cart first translate along the first axis and then the top cap rocks around the second axis.

This switch assembly according to the second aspect of the present invention may have all the features of the switch assembly according to the first aspect of the present invention.

In particular, the push activation force may be lower than the rocker activation force. Alternatively or in combination, guiding means may prevent the rocking movement as long as the translation movement is not completed.

A third aspect of the present invention is a car infotainment system including a processing system and a switch assembly according to any of the first aspect or the second aspect of the present invention.

In aspects, the switch assembly is configured to send a rocker signal upon activation of the intermediate contactor and the processing system is programmed so that a predetermined action is selected or triggered by said rocker signal.

In aspects, the switch assembly is configured to send a push signal upon activation of the bottom contactor and the processing system is programmed so that a predetermined action is selected or triggered by said rocker signal.

In aspects, the switch assembly is configured to send a touch signal upon activation of the touch sensor and wherein the processing system is programmed so that a predetermined action is selected by said touch signal.

In aspects, the switch assembly send: a rocker signal upon activation of the intermediate contactor, a push signal upon activation of the bottom contactor, and a touch signal upon activation of the touch sensor; wherein the processing system is programmed so that a predetermined action or function is selected by said touch signal and triggered by the push signal and/or the rocker signal. Such a car infotainment system provides a simple and intuitive operation and a high perceived quality.

A fourth aspect of the present invention is a vehicle integrating the switch assembly according to any of the first or second aspect of the invention and/or a car infotainment system according to the third aspect of the invention.

BRIEF DESCRIPTION OF THE DRAWINGS

Other features and purposes of the disclosure will become more explicit by means of reading the detailed statement of the non-restrictive embodiments made with reference to the accompanying drawings.

DETAILED DESCRIPTION

The present invention relates to a switch assembly that can be implemented in all kinds of electronic panels, consoles and appliances, such as household appliances, portable electronics, TV and video games, as well as in private, utility, industrial or military vehicles, construction machines, ships, aircraft or industrial systems. The present switch assembly may be integrated preferably in a vehicle, for example on a dashboard of a vehicle, in order to provide control to embarked functions such as air conditioning, windscreen wipers, seat and windows settings, navigation or music playing.

First Embodiment

According to a first embodiment shown in FIGS. 1-4, a switch assembly 10 includes a top cap 20 preferably flush with a top surface of the cover 30. In an example, at least a part of the top surface 21 of the top cap 20 such as a peripheral surface of the top cap 20 is located on the same plane as the cover 30. Alternatively, most or the totality of the top surface 21 of the top cap 20 is flush with the cover 30.

Figure 2:
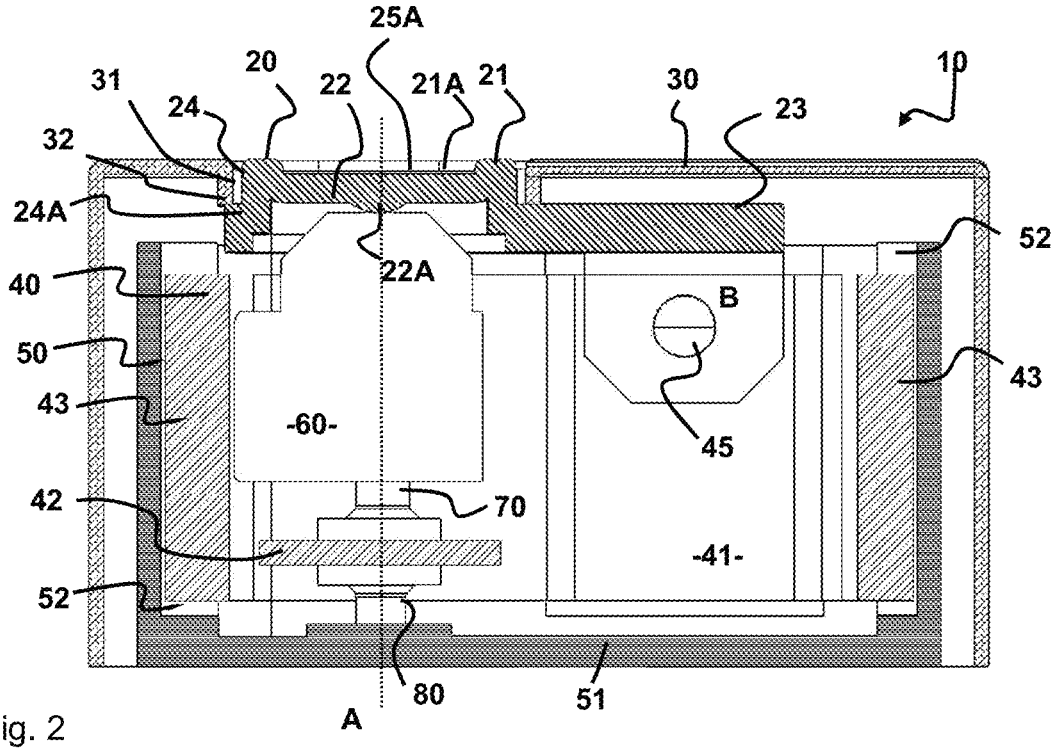
FIG. 2 shows a side, cross-section view of the switch assembly of FIG. 1 in a rest or initial position.

FIG. 2 relates to a cross section of the present switch assembly showing the top cap 20 substantially flush with the top surface of the cover 30 and positioned above an intermediate cart 40, which is in sliding engagement with and housed into a socket 50.

Figure 1:
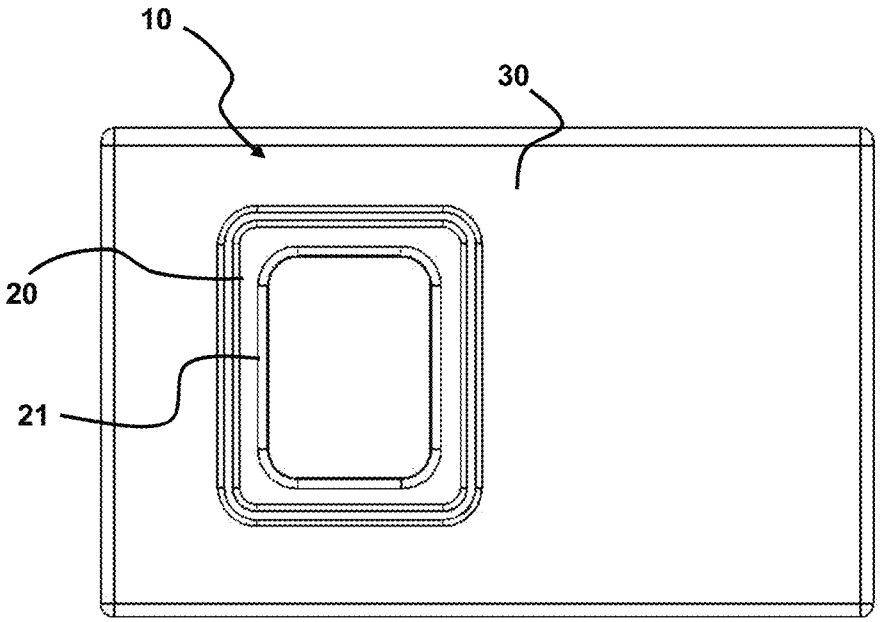
FIG. 1 shows a top view of a switch assembly according to an example of the present invention, i.e. as viewed by the user.

With reference to FIGS. 1 and 2, the top cap 20 includes a pushing surface 21A for example in the center of and/or slightly recessed from the top surface 21. This pushing surface 21A is arranged to be touched and pushed or pressed by the user willing to interact with the present switching assembly.

The top cap 20 may have a back surface 22 provided with a bottom protrusion 22A and a side surface 24. For example, the bottom protrusion 22A may be hemispherical. The side surface 24 of the top cap 20 can have an optional step 24A. The top cap 20 may receive or be provided with one or several touch sensors 25A, for example integrated to the pushing surface 21A and detecting a contact with an object or a person. For example, the touch sensor can be a capacitive touch sensor. The top cap 20 may have a lateral leg 23, for example extending from an edge of the top cap 20 or from an edge of the back surface 22.

The cover 30 can have a side edge 31 and a bottom edge 32. In the rest position of the top cap 20, the bottom edge 32 of the cover 30 may optionally contact or abut the step 24A of the top cap 20 and/or the lateral leg 23, for example to prevent an upper movement of the top cap 20 with regard to the cover 30 when the top cap 20 is in the rest position of FIG. 2. In addition, the side edge 31 may face the side surface 24 of the top cap 20, or even contacts this side surface 24, providing a translation movement of the top cap 20 remains possible.

Preferably, a gap between the side surface 24 of the top cap 20 and the side edge 31 of the cover 30 is as small as possible, for example 2.0 mm or less, preferably 1.0 mm or less and again preferably 0.5 mm or less.

The intermediate cart 40 is located into the socket 50, between the top cap 20 and a bottom surface 51 of the socket 50. The intermediate cart 40 has for example a frame 41 and a tray 42 which may be fixed directly or indirectly to the frame 41. The tray 42 at least translates simultaneously with the frame 41. The tray 42 supports a pusher 60 located on an intermediate contactor 70. The top cap 20 is in a pivot engagement with regard to the intermediate cart 40, thanks to the hinge 45 provided between the frame 41 and the lateral leg 23 of the top cap 20. This hinge 45 may be located on an external surface of the frame 41 and part of the lateral leg 23 is visible by transparency in FIGS. 2-4. Alternatively, the hinge 45 may be located on an internal surface of the frame 41 (not shown).

The pusher 60 may be in slidable or in sliding engagement with the frame 41. The pusher 60 further has a top surface in contact or in engagement with the protrusion 22A of the top cap 20. The tray 42 is linked to the bottom surface 51 of the socket 50 by a bottom contactor 80.

The intermediate cart 40 is slidable with regard to the socket 50, for example through a prismatic joint, and the intermediate cart 40 and the socket 50 can include guiding means such as pins accommodated in respective slots or rails.

In the example of FIGS. 1-5, the intermediate cart 40 includes a plurality of side protrusions 43 such as two, three or four side protrusions 43 engaging linear slots 52 provided on the socket 50, for example on a lateral surface of the socket 50.

The intermediate contactor 70 and the bottom contactor 80 may be contactors, activators or "switches" of any kind, such a silicon pads or tact switches. Preferably the intermediate contactor 70 and the bottom contactor show an elastic behavior i.e. providing a return or feedback force in a direction opposite to the activation direction, when activated. As will be detailed below, the intermediate contactor 70 is intended to be activated following a pivot movement of the top cap 20 and the bottom contactor 80 is intended to be activated by a sliding or translation movement of the intermediate cart 40, for example resulting from a pressure applied by a user on the top surface 21 or the pushing surface 21A of the top cap 20.

The activation force of the sliding movement of the top cap 20 and the intermediate cart 40 with regard to the socket 50, i.e. the force to be applied on the top cap 20 to perform this sliding movement, is lower than the activation force of the pivot movement of the top cap 20 with regard to the intermediate cart 40.

For example, the activation force (or actuation force) of the intermediate contactor 70 may be higher than the activation force of the bottom contactor 80 according to the targeted application of the switch assembly, for example at least 30% more, preferably 50% or even 75 or 100% more. For example, the activation force of the bottom contactors 80 may be 1 to 5 N, preferably 2 to 4 N and again preferably 3 N. The activation force of the intermediate contactor 70 may be 5 to 10 N, preferably 6 to 8 N and again preferably 7 N.

For example, the intermediate contactor 70 and the bottom contactor 80 may use the same kind of contactor with the same activation force. In this case, the intermediate contactor 70 may be doubled with regard to the bottom contactor 80, in order to provide for a higher or doubled activation force. Alternatively or in combination, the size of the intermediate contactor 70 may be more important, for example doubled, with regard to the size of the bottom contactor 80. In addition, elastic elements or spring members may be combined with or around the contactors in order to generate the appropriate activation forces.

The tray 42 may be a PCB (i.e. Printed Circuit Board). In other words, the tray 42 may realize electrical connections between the systems or functions intended to be controlled by the switch assembly 10 and the intermediate contactor 70, the bottom contactor 80 and/or the touch sensor 25A. These electrical connections are not represented in the appended figures for the sake of clarity and may be any kind of electrical connection known by the skilled person, for example using flexible wires or conductor tracks.

In the first embodiment of FIGS. 1-4, the top cap 20 and the tray 42 are substantially planar elements, parallel with the bottom surface 51 and transversal to a first axis A. The first axis A may also be the axis of the translation or sliding movement of the top cap 20 and the intermediate cart 40 with regard to the socket 50 when a pressure is applied to the top cap 20. The pushing surface 21A may also be parallel with the bottom surface 51 and also transversal to this first axis A.

In addition, the hinge 45 may form a second axis B or rotating axis that can be perpendicular or transversal to the first axis A. The second axis B may not cross the first axis A.

Operation of the First Embodiment

Figure 3:
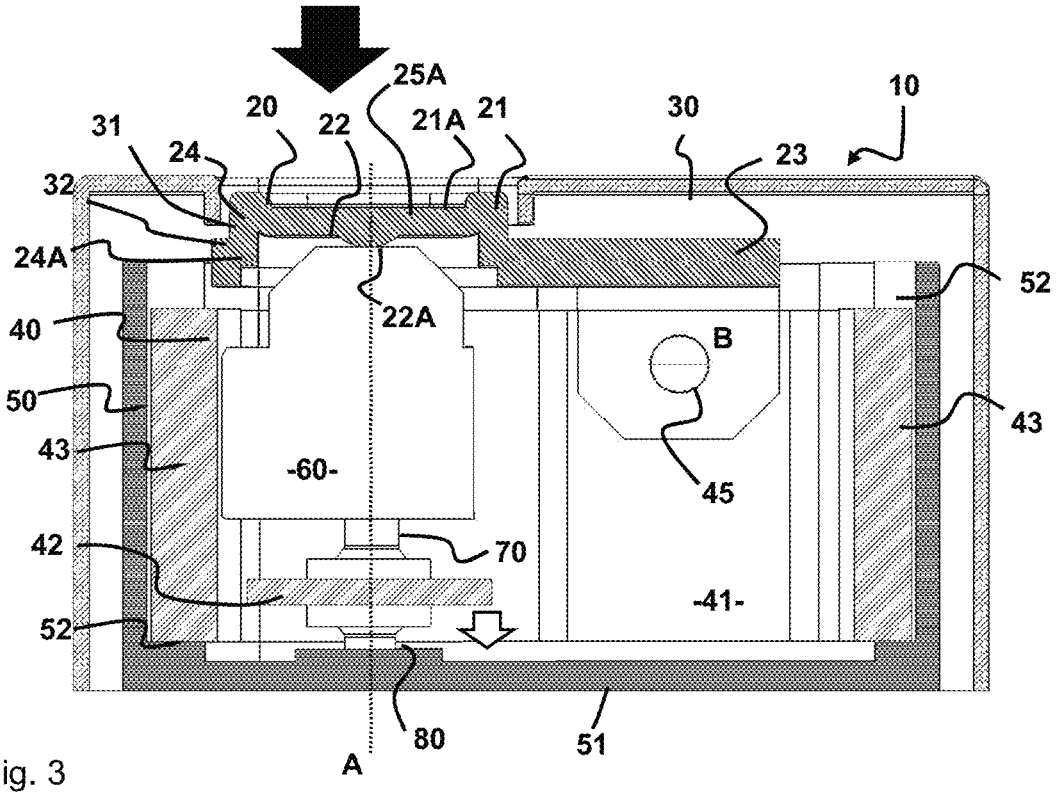
FIG. 3 shows a side, cross-section view of the switch assembly of FIG. 2 in a switch position.
Figure 4:
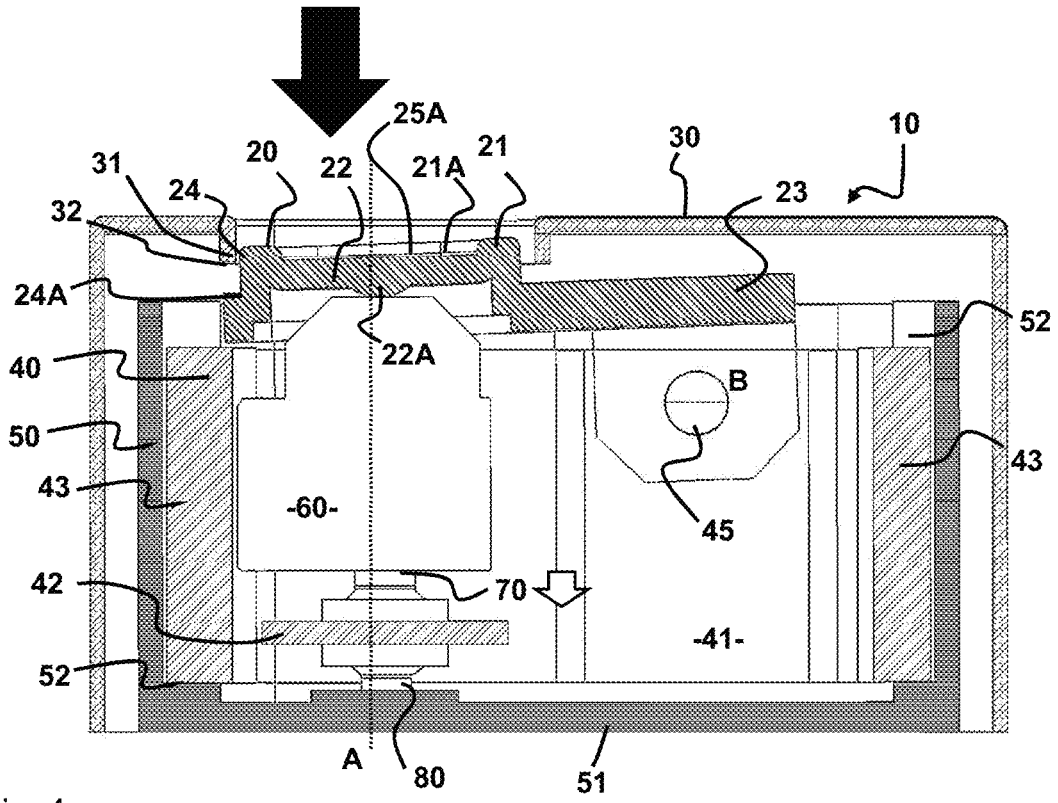
FIG. 4 shows a side, cross-section view of the switch assembly of FIG. 3 in a tilted position.

The operation of the switch assembly according to the preferred embodiment of FIGS. 1 and 2 is now described with regard to FIGS. 3 to 4, wherein the position of FIG. 2 represents a rest or initial position.

In FIG. 3, a pressure is applied to the pushing surface 21A, for example by the finger of the user (see the black arrow in FIG. 3). This pressure is transmitted by the top cap 20 to the intermediate cart 40 through the pusher 60 and the intermediate contactor 70. Because the activation force of the intermediate contactor 70 is higher than the activation force of the bottom contactor 80, only the bottom contactor 80 is activated: its height is reduced and an assembly formed by the top cap 20, the pusher 60, the intermediate contactor 70 and the intermediate cart 40 moved down by a sliding movement (see the white arrow in FIG. 3), for example along the first axis A. The switch assembly is then in a switch position.

The activation of the bottom contactor 80 may generate a push signal, for example transmitted through electrical contacts of the tray 42 and such a push signal may trigger a predetermined action such as an embarked function of the vehicle. In addition, the touch sensor 25A may generate a touch signal if present.

In FIG. 4, the pressure is increased on the pushing surface 21A (see the black arrow in FIG. 4). However, the bottom contactor 80 is in an activated position and may form an abutment against the bottom surface 51 of the socket 50. In addition, the side protrusions 43 are in an abutment against a bottom surface of the linear slots 52. Consequently, the intermediate contactor 70 is activated by the increased pressure and its height decreases (see the white linear arrow in FIG. 8), thus allowing a pivot movement of the top cap 20

(see the circular white arrow in FIG. 8) thanks to the hinge 45 and around the second axis B. The switch assembly is then in a tilted position.

The activation of the intermediate contactor 70 may generate a rocker signal, for example transmitted through electrical contacts of the tray 42 and such a rocker signal may trigger a further increase or reduction of a value or variable of the embarked function.

When the pressure is removed from the top cap 20, the intermediate contactor 70 and the bottom contactor 80 may act as elastic means (or biasing means) and push back the top cap 20 and the intermediate cart 40 in the initial or rest position of FIG. 2. Alternatively or in combination, spring members may generate a return force allowing the intermediate cart 40 and the top cap 20 to return to their initial position.

Second Embodiment

Figure 5:
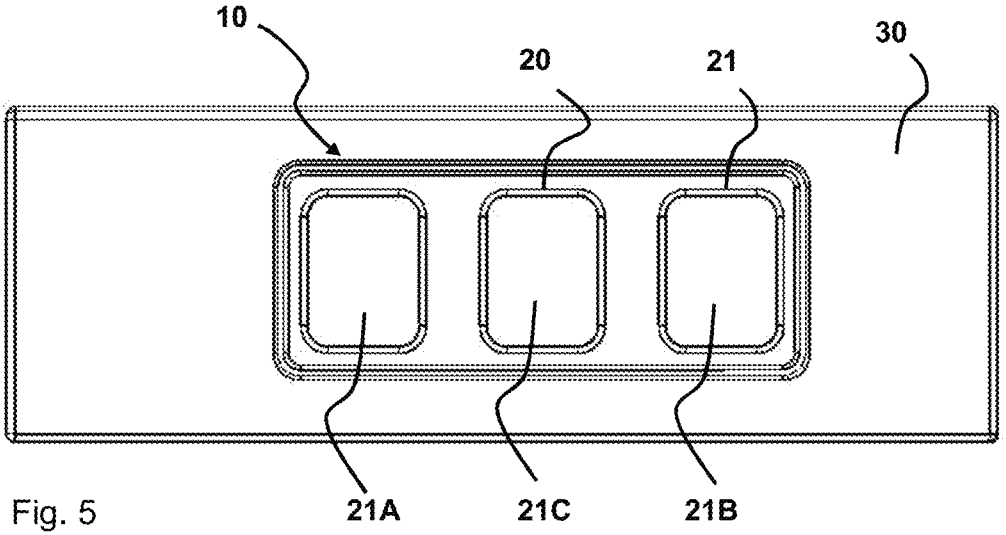
FIG. 5 shows a top view of a switch assembly according to another example of the present invention, i.e. as viewed by the user.
Figure 6:
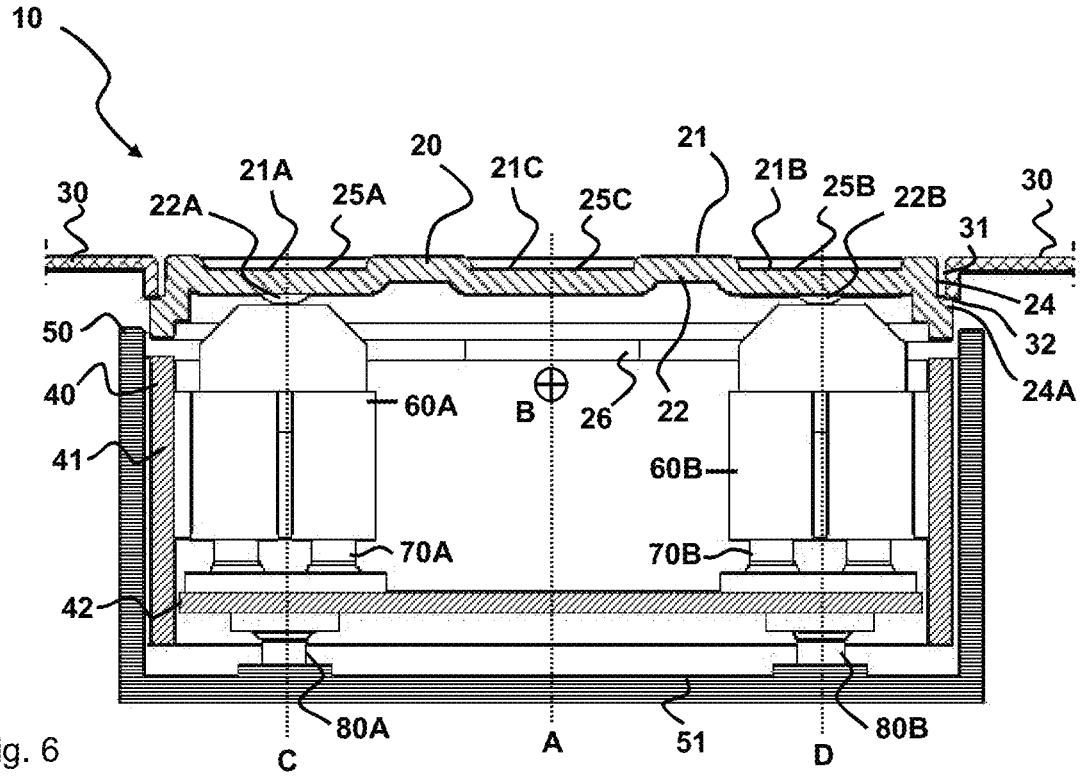
FIG. 6 shows a side, cross-section view of the switch assembly of FIG. 5 in a rest or initial position.

According to a second embodiment shown in FIGS. 5-9, the switch assembly 10 includes a top cap 20 preferably flush with a cover 30 i.e. located on the same plane, similarly to the first embodiment. FIG. 6 relates to a cross section of the present switch assembly showing the top cap 20 flush with the cover 30 and positioned above an intermediate cart 40 in a slidable engagement with and housed into a socket 50.

With reference to FIGS. 5 and 6, the top cap 20 includes a top surface 21 provided with three different pushing surfaces, i.e. two side pushing surfaces 21A and 21B and a central pushing surface 21C. These pushing surfaces 21A, 21B, 21C are arranged to be touched and pushed by the user willing to interact with the present switch assembly. The pushing surfaces 21A, 21B, 21C may be slightly recessed with regard to the top surface 21.

The top cap 20 may have a back surface 22 provided with two bottom protrusions 22A and 22B, for example hemispherical and a side surface 24. The side surface 24 of the top cap 20 can have an optional step 24A. The top cap 20 may receive or be provided with touch sensors 25A, 25B and 25C, for example integrated to the pushing surfaces 21A, 21B, 21C, respectively. The top cap 20 may have a bottom leg 26, for example extending from an edge of the top cap 20 or from an edge of the back surface 22.

The cover 30 can have a side edge 31 and a bottom edge 32. In the rest position of the top cap 20 visible in FIG. 6, the bottom edge 32 of the cover 30 may optionally contact or abut the step 24A of the top cap 20, for example to prevent an upper movement of the top cap 20 with regard to the cover 30. In addition, the side edge 31 may face the side surface 24 of the top cap 20, or even contacts this side surface 24, providing a translation or sliding movement of the top cap 20 remains possible.

Preferably, a gap between the side surface 24 of the top cap 20 and the side edge 31 of the cover 30 is as small as possible, for example 2.0 mm or less, preferably 1.0 mm or less and again preferably 0.5 mm or less.

The intermediate cart 40 is located into the socket 50, between the top cap 20 and a bottom surface 51 of the socket 50. The intermediate cart 40 has for example a frame 41 and a tray 42 which may be fixed directly or indirectly to the frame 41. The tray 42 supports two pushers 60A and 60B located on intermediate contactors 70A and 70B. The tray 42 at least translates simultaneously with the frame 41. The top cap 20 is in a pivot engagement with regard to the intermediate cart 40, for example thanks to a hinge (not visible in FIGS. 5-9) provided between the frame 41 and the bottom leg 26 of the top cap 20.

The pushers 60A and 60B may be in slidable or in sliding engagement with the frame 41. Each of the pushers 60A, 60B further has a top surface in contact or in engagement with one of the bottom protrusions 22A, 22B of the top cap 20. The tray 42 is linked to the bottom surface 51 of the socket 50 by two bottom contactors 80A and 80B.

The intermediate cart 40 is slidable with regard to the socket 50, for example through a prismatic joint, and the intermediate cart 40 and the socket 50 can include guiding means such as pins accommodated in respective slots or rails (not shown).

The intermediate contactors 70A, 70B and the bottom contactors 80A, 80B may be contactors, activators or "switches" of any kind, such a silicon pads or tact switches. Preferably the intermediate contactors 70 and the bottom contactors show an elastic behavior i.e. providing a return or feedback force in a direction opposite to the activation direction, when activated. As will be detailed below, the intermediate contactors 70A, 70B are intended to be activated following a pivot movement of the top cap 20 and the bottom contactors 80A, 80B are intended to be activated by a translation or sliding movement of the top cap 20, for example resulting from a pressure applied by the user on the top surface 21 or on one of the pushing surfaces 21A, 21B, 21C of the top cap 20.

The activation force of the sliding movement of the top cap 20 and the intermediate cart 40 with regard to the socket 50 is lower than the activation force of the pivot movement of the top cap 20 with regard to the intermediate cart 40, similarly to the first embodiment.

The tray 42 may be a PCB or Printed Circuit Board. In other words, the tray 42 may realize electrical connections between the systems or functions intended to be controlled by the switch assembly 10 and the intermediate contactor 70A, 70B, the bottom contactor 80A, 80B and/or the touch sensors. These electrical connections are not represented in the appended figures for the sake of clarity and may be any kind of electrical connection known by the skilled person, for example using flexible wires or conductor tracks.

Similarly to the first embodiment, the top cap 20 and the tray 42 are substantially planar elements, parallel with each other and with the bottom surface 51 and transversal to a first axis A. The first axis A may also be the axis of the translation or sliding movement of the top cap 20 and the intermediate cart 40 with regard to the socket 50, when a pressure is applied to the top cap 20. The central pushing surface 21C may be transversal to this first axis A. In addition, the top cap 20 may rock or pivot around a second axis B that can be perpendicular to the first axis A.

Further, the side pushing surfaces 21A, 21B may be respectively aligned with the pushers 60A, 60B and the intermediate contacts 70A, 70B, for example along a third axis C and a fourth axis D. These third and fourth axes may be parallel to and offset from the first axis A. For example, the bottom contactors 80A and 80B may also be aligned on the third axis C and the fourth axis D, respectively.

A significant difference with the first embodiment is that the first axis A crosses the second axis B, which allows two different rocking or pivot movements of the top cap 20, according to the pushing surface which is pressed by the user.

Operation of the Second Embodiment

Figure 7:
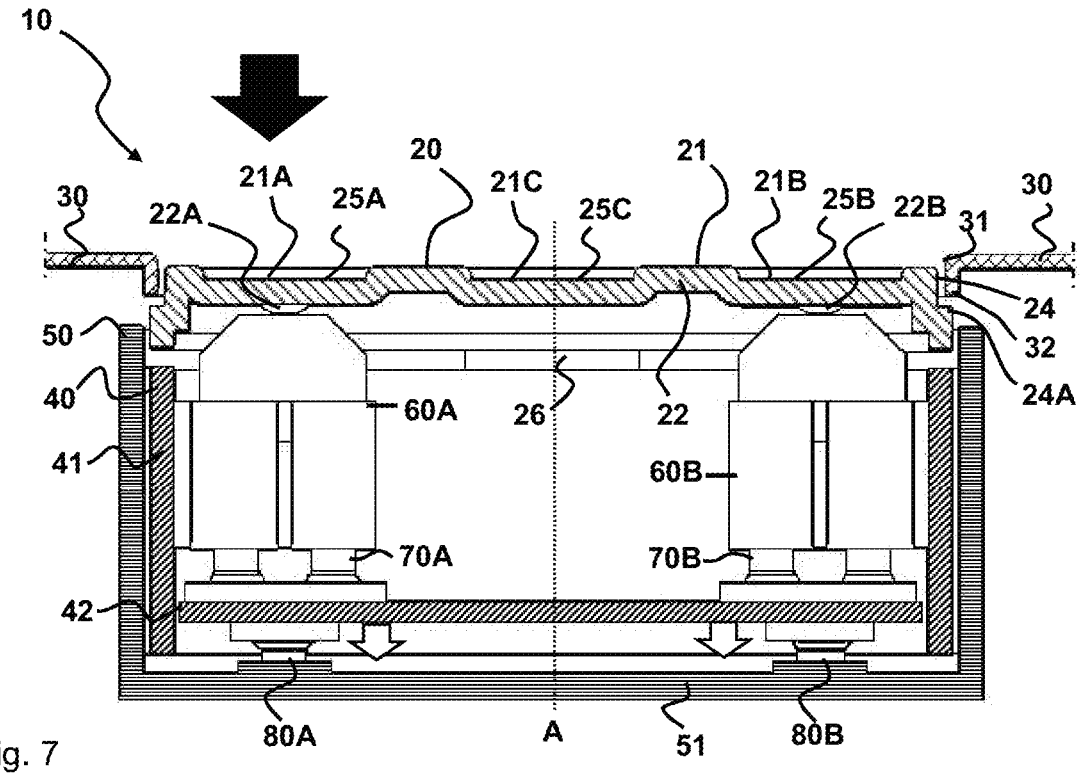
FIG. 7 shows a side, cross-section view of the switch assembly of FIG. 5 in a switch position.
Figure 8:
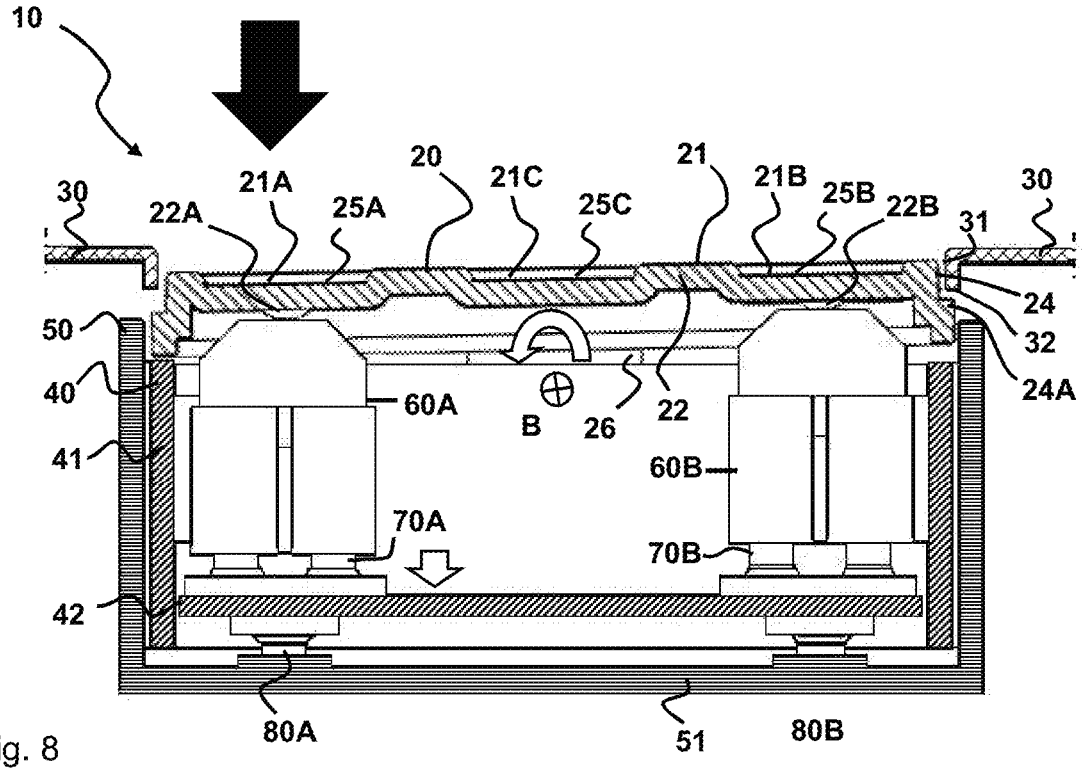
FIG. 8 shows a side, cross-section view of the switch assembly of FIG. 5 in a tilted position.
Figure 9:
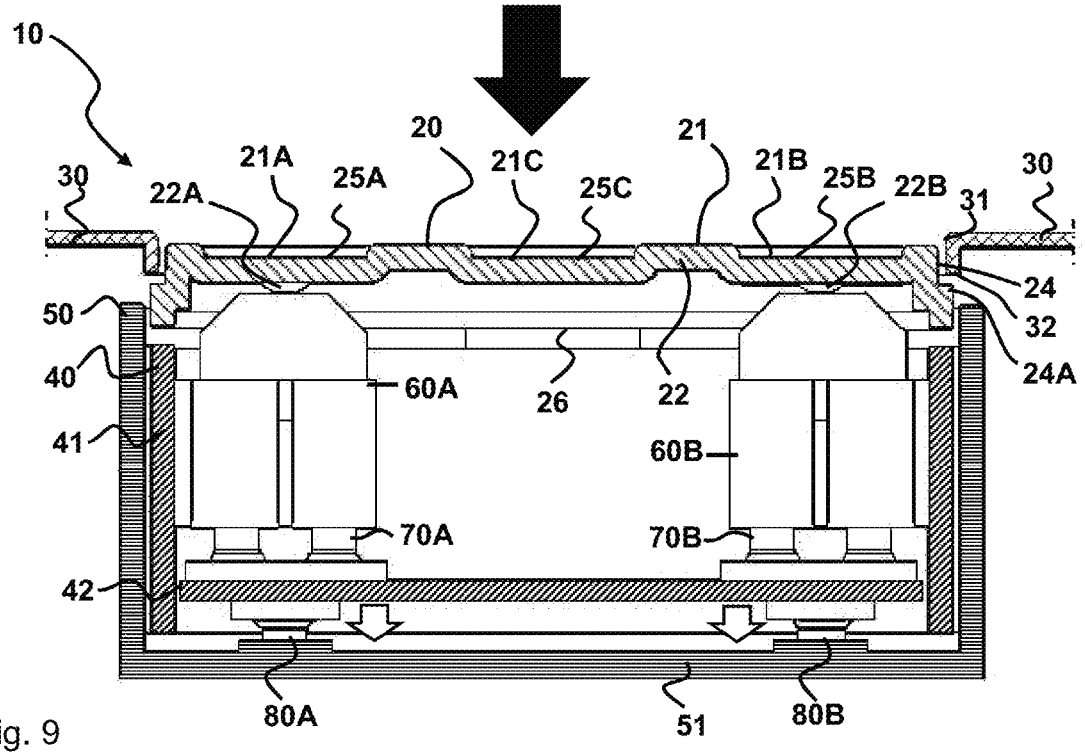
FIG. 9 shows a side, cross-section view of the switch assembly of FIG. 9 in a switch position.

The operation of the switch assembly according to the preferred embodiment of FIGS. 5 and 6 is now described with regard to FIGS. 7 to 9, wherein FIG. 6 shows a rest or initial position.

In FIG. 7, a pressure is applied to the side pushing surface 21A, for example by the finger of the user (see the black arrow in FIG. 7) and thus along the third axis C. This pressure is transmitted by the top cap 20 to the intermediate cart 40 through the pushers 60A, 60B and the intermediate contactors 70A, 70B. Because the activation force of the intermediate contactors 70A, 70B is higher than the activation force of the bottom contactors 80A, 80B, only the bottom contactors 80A, 80B are activated. Consequently, their height is reduced and the assembly formed by the top cap 20, the pusher 60A, 60B, the intermediate contactors 70A, 70B and the intermediate cart 40 moved down by a translation movement (see the white arrows in FIG. 7), for example along the first axis A. The switch assembly is then in a switch position.

The activation of the bottom contactors 80A, 80B may generate a push signal, for example transmitted through electrical contacts of the tray 42 and such a push signal may trigger a predetermined action such as an embarked function of the vehicle. In addition, the touch sensor 25A may generate a touch signal, which may allow to select a specific embarked function, such as increasing or reducing a value of the embarked function.

In FIG. 8, the pressure is increased on the side pushing surface 21A (see the black arrow in FIG. 8). However, the bottom contactors 80A and 80B are in an activated position and thus form an abutment against the bottom surface 51 of the socket 50. Consequently, the intermediate contactor 70A is activated by the increased pressure and its height decreases (see the white linear arrow in FIG. 8), thus allowing a pivot movement of the top cap 20 (see the circular white arrow in FIG. 8), for example around the second axis B. In the meantime, the opposite intermediate contactor 70B is not activated, as it is aligned with the fourth axis D and offset from the third axis C on which a pressure is applied (see FIG. 6). The switch assembly is then in a tilted position.

The activation of the intermediate contactor 70A may generate a rocker signal, for example transmitted through electrical contacts of the tray 42 and that may trigger a further increase or reduction a value of the embarked function, for example.

When the pressure is removed from the top cap 20, the intermediate contactors 70A and the bottom contactors 80A, 80B may act as elastic means (or biasing means) and push back the top cap 20 and the intermediate cart 40 in the position of FIG. 6, i.e. in the initial position. Alternatively or in combination, spring members may generate a return force allowing the intermediate cart 40 and the top cap 20 to return to their initial position visible in FIG. 6.

The same kinematic as shown in FIGS. 7 and 8 also exists when a pressure is applied on the other side pushing surface 21B, i.e. along the fourth axis D.

In FIG. 9, a pressure is applied on the central pushing surface 21C, for example by the finger of the user (see the black arrow in FIG. 9). Similarly to FIG. 7, this pressure is transmitted by the top cap 20 to the intermediate cart 40 through the pushers 60A, 60B and the intermediate contactors 70A, 70B. In the embodiment in which a hinge is provided between the top cap 20 and the intermediate cart 40, the hinge prevents a sliding movement of the top cap 20 with regard to the intermediate cart 40 and thus prevents activation of the intermediate contactors 70A, 70B. The switch assembly is then in a switch position.

Consequently, only the bottom contactors 80A, 80B are activated: their height is reduced and the assembly of the top cap 20, the pusher 60A, 60B, the intermediate contactors 70A, 70B and the intermediate cart 40 moved down by a translation or sliding movement (see the white arrows in FIG. 9). This activation may generate a push signal, while the contact between the user's finger and the center pushing surface 21C may trigger a touch signal, as previously explained.

In another embodiment (not shown) in which no hinge is provided between the top cap 20 and the intermediate cart 40, the intermediate contactors 70A, 70B may be activated if a greater pressure is applied on the central pushing surface 21C.

Although the present invention has been described and illustrated in detail, it is clearly understood that the same is by way of illustration and example only and is not to be taken by way of limitations, the scope of the present invention being limited only by the terms of the appended claims. In particular, the first and the second embodiment can be combined.

For example, the top cap 20 may be in a spherical engagement with regard to the intermediate cart 40, for example through a ball joint and the top cap can thus pivot or rock along two second axes. In this case, more than two side pushing surfaces 21A, 21B may be considered and additional intermediate contactors and/or pusher may be provided accordingly.

Further, the side surfaces, the pusher and the contactors may not be aligned along the third and fourth axes, provided a pressure on a side surface activate the corresponding contactor.

Finally, the bottom contactors may not be aligned along the third axis C and the fourth axis D and only one contactor or more than two contactors such as three or four contactors may be provided between the bottom surface 51 and the intermediate cart 40 and/or the tray 42.

What is claimed is:

1. A switch assembly comprising:

a socket;

an intermediate cart located in the socket, the intermediate cart configured to slidably engage the socket to define a sliding movement upon an activation force applied to a top cap;

the top cap located in the socket, the top cap configured to spherically or pivotally engage the intermediate cart to define a spherical or pivot movement, respectively, of the top cap upon a secondary activation force applied to the top cap, the activation force of the sliding movement being lower than the secondary activation force of the spherical or pivot movement; and a cover located above and covering a portion of the socket, a top surface of the cover being flush with at least a part of a top surface of the top cap.

2. The switch assembly of claim 1, wherein the switch assembly further comprises:

an intermediate contactor configured to be activated by the spherical or pivot movement of the top cap; and a bottom contactor configured to be activated by the sliding movement of the intermediate cart.

3. The switch assembly of claim 2, wherein the intermediate contactor and the bottom contactor are configured to push the top cap and the intermediate cart back to a resting position.

4. The switch assembly of claim 2, wherein the intermediate cart includes a tray that supports a pusher located on the intermediate contactor and is linked to a bottom surface of the socket by the bottom contactor.

5. The switch assembly of claim 4, wherein the tray comprises a printed circuit board configured to complete electrical connections between systems to be controlled by the switch assembly.

6. The switch assembly of claim 1, wherein a totality of the top surface of the top cap is flush with the top surface of the cover.

7. The switch assembly of claim 1, wherein a gap between a side surface of the top cap and a side edge of the cover is less than 1.0 mm.

8. The switch assembly of claim 1, wherein a bottom edge of the cover abuts a lateral protrusion of the top cap, the lateral protrusion extending from an edge or bottom surface of the top cap, the bottom edge of the cover configured to prevent an upper movement of the top cap in relation to the cover when the top cap is in a resting position.

9. The switch assembly of claim 1, wherein the switch assembly is integrated into an infotainment system of a vehicle.

10. A system comprising:

a processing system; and a switch assembly, the switch assembly comprising:

a socket;

an intermediate cart located in the socket, the intermediate cart configured to slidably engage the socket to define a sliding movement upon an activation force applied to a top cap;

the top cap located in the socket, the top cap configured to spherically or pivotally engage the intermediate cart to define a spherical or pivot movement, respectively, of the top cap upon a secondary activation force applied to the top cap, the activation force of the sliding movement being lower than the secondary activation force of the spherical or pivot movement; and a cover located above and covering a portion of the socket, a top surface of the cover being flush with at least a part of a top surface of the top cap.

11. The system of claim 10, wherein:

the switch assembly further comprises an intermediate contactor configured to be activated by the spherical or pivot movement of the top cap, the intermediate contactor being located between the top cap and the intermediate cart, the intermediate contactor defining at least part of the secondary activation force of the spherical or pivot movement;

the switch assembly is configured to send a rocker signal upon activation of the intermediate contactor; and the processing system is programmed so that a predetermined action is selected or triggered by the rocker signal.

12. The system of claim 10, wherein the system comprises an infotainment system of a vehicle.

13. A system comprising:

a processing system; and a switch assembly, the switch assembly comprising:

a socket;

an intermediate cart located in the socket, the intermediate cart configured to slidably engage the socket to define a sliding movement upon an activation force applied to a top cap;

the top cap located in the socket, the top cap configured to spherically or pivotally engage the intermediate cart to define a spherical or pivot movement, respectively, of the top cap upon a secondary activation force applied to the top cap, the activation force of the sliding movement being lower than the secondary activation force of the spherical or pivot movement, the top cap comprising multiple pushing surfaces; and a cover located above and covering a portion of the socket, a top surface of the cover being flush with at least a part of a top surface of the top cap.

14. The system of claim 13, wherein the switch assembly further comprises:

multiple intermediate contactors configured to be activated by the spherical or pivot movement of the top cap, each of the multiple intermediate contactors being located between a pushing surface of the top cap and the intermediate cart; and multiple bottom contactors configured to be activated by the sliding movement of the intermediate cart.

15. The system of claim 14, wherein:

at least one of the multiple pushing surfaces of the top cap comprises a touch sensor;

the switch assembly is configured to send:

a rocker signal upon activation of at least one of the multiple intermediate contactors;

a push signal upon activation of the multiple bottom contactors; and a touch signal upon activation of the touch sensor; and the processing system is programmed so that a predetermined action is selected by the touch signal and triggered by at least one of the push signal or the rocker signal.

16. The system of claim 14, wherein the intermediate cart includes a printed circuit board that supports multiple pushers, each of the multiple pushers being located on an intermediate contactor of the multiple intermediate contactors and linked to a bottom surface of the socket by a respective bottom contactor of the multiple bottom contactors.

17. The system of claim 13, wherein a totality of the top surface of the top cap is flush with the top surface of the cover.

18. The system of claim 13, wherein a gap between a side surface of the top cap and a side edge of the cover is less than 1.0 mm.

19. The system of claim 13, wherein a bottom edge of the cover abuts a lateral protrusion of the top cap, the lateral protrusion extending from an edge or bottom surface of the top cap, the bottom edge of the cover configured to prevent an upper movement of the top cap in relation to the cover when the top cap is in a resting position.

20. The system of claim 13, wherein the system comprises an infotainment system of a vehicle.

* * * * *